US005862102A

United States Patent [19]

Trainello

[11] Patent Number: 5,862,102

[45] Date of Patent: Jan. 19, 1999

[54] CLOCK

[76] Inventor: Jerry S. Trainello, 4947 Taywater Dell, Sarasota, Fla. 34235

[21] Appl. No.: 998,143

[22] Filed: Dec. 24, 1997

[51] Int. Cl.[6] ..... G04B 19/00

[52] U.S. Cl. ..... 368/23; 368/77

[58] Field of Search ..... 368/223, 233, 368/234, 77, 76

[56] References Cited

U.S. PATENT DOCUMENTS 5,694,378 12/1997 Tosuka ..... 368/223

*Primary Examiner*—Bernard Roskoski
*Attorney, Agent, or Firm*—Charles J. Prescott

[57] ABSTRACT

A clock having conventional clock timing mechanism operably connected to a supporting hour hand, a minute hand, a modified second hand, and a freely pivotable object support hand. The object support hand swings freely in pendulum fashion, taking a downwardly at-rest position when not being otherwise articulated by the second hand. The second hand and/or the object support hand are modified to cooperatively engage with one another each time the second hand passes the object support hand so as to carry or pivotally lift the object support hand to the top of the arch of the second hand, at which point the object support hand freely pivots downwardly and swings in pendulum fashion until again coming to its at-rest position. The object support hand may include an enlarged distal end having the appearance of a miniature flyable object such as a strikeable sports related object which appears to be struck and to fly each time the second hand sweeps by and carryingly engages the object support hand.

1 Claim, 2 Drawing Sheets

CLOCK

BACKGROUND OF THE INVENTION

SCOPE OF INVENTION

This invention relates generally to a conventional clock or timepiece, and more particularly a visual effect clock having a second hand which sweeps by to carry a freely pivotable object support hand on each revolution of the second hand.

PRIOR ART

Timepieces and clocks are well known to have a clock timing mechanism which is operably engaged by an output shaft thereof to moveable hour, minute and second hands which move in well known corresponding time order. Applicant is also aware of an unpatented clock using magnets concealed behind the face of a clock which interact to move magnetic balls in corresponding inner and outer grooves of a clock face to give the appearance that these balls moving in unassisted manner show the correct time of day.

Applicant is not aware of any prior art which utilizes a uniquely configured structure of the second hand to repeatedly sweep by to contact and carry an object support hand through approximately half of its revolution from the bottom to the top of the arc of the second hand whereupon the object support hand freely swings downwardly and oscillates back and forth in pendulum fashion until coming to rest in a downwardly hanging position, this cycle being repeated at each revolution of the second hand to produce a unique visual effect.

BRIEF SUMMARY OF THE INVENTION

This invention is directed to a visual effect clock having conventional clock timing mechanism operably connected to a supporting hour hand, a minute hand, a modified second hand, and a freely pivotable object support hand. The object support hand swings freely in pendulum fashion, taking a downwardly at-rest position when not being otherwise made to articulate by the second hand. The second hand and/or the object support hand are modified to cooperatively engage with one another each time the second hand passes the object support hand so as to carry or pivotally lift the object support hand to the top of the arch of the second hand, at which point the object support hand freely pivots downwardly and swings in pendulum fashion until again coming to its at-rest position. The object support hand may include an enlarged distal end having the appearance of a miniature flyable object such as a strikeable sports related object which appears to be struck and to fly each time the second hand sweeps by and carryingly engages the object support hand.

It is therefore an object of this invention to provide a clock for showing the correct time and including an additional freely pivotable object support hand which is made to articulate by being carried through one half of a stroke upwardly from its downwardly hanging rest position and then having the appearance of flying freely from the top of the arch of the second hand downwardly in pendulum fashion back to the at-rest position.

It is another object of this invention to provide a sports related clock which includes a modified second hand and newly added freely pivotable sport objects support hand which are cooperatively structured and viewably formed to create the appearance or visual effect of a flyable sports object being struck and made to fly by a corresponding striking sports related implement.

It is yet another object of this invention to provide a golf related clock which repeatedly has the appearance of a simulated miniature golf club striking a golf ball and making it fly through the distal end arc of the additional object support hand.

In accordance with these and other objects which will become apparent hereinafter, the instant invention will now be described with reference to the accompanying drawings.

DETAILED DESCRIPTION OF THE INVENTION

Figure 1:
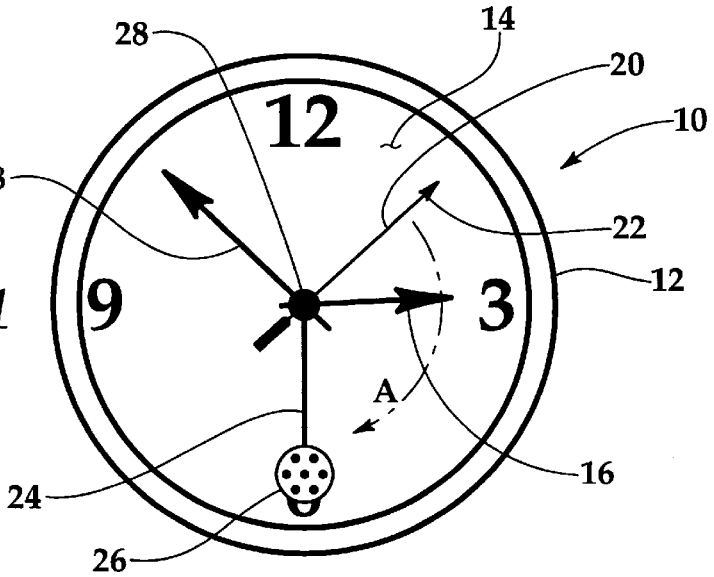
FIG. 1 is a simplified front elevation view of a front face and housing of a conventional clock modified in accordance with the concept of the present invention.

Referring now to the drawings, the invention in one embodiment is shown generally at numeral 10 in FIGS. 1 to 5. Each of the embodiments 10 includes a clock housing 12 which supports a conventional clock timing mechanism 30 having an operably disposed output shaft 28 extending from the housing 12 centrally through the face 14 of the clock 10. By this conventional arrangement, the hour hand 16, the minute hand 18, and a modified or improved second hand 20 operate in the conventional fashion to provide viewable indicia of the correct time of day.

The invention 10 also generally includes a freely pivotable object support hand 24 which is supportively connected in the preferred embodiment for free pendulum like pivotable or swinging motion to the output shaft 28 forwardly of the second hand 20. However, other sequential position arrangements on the output shaft 28 are also envisioned within the scope of this invention. The object support hand 24 includes an enlarged or weighted distal end portion 26 which, in this embodiment 10, has the appearance of a miniature golf ball. However, a broad range of other objects, both sports related and otherwise, are envisioned within the scope of this invention, any of which might have the useful or entertaining appearance of being moved or struck.

Figure 2:
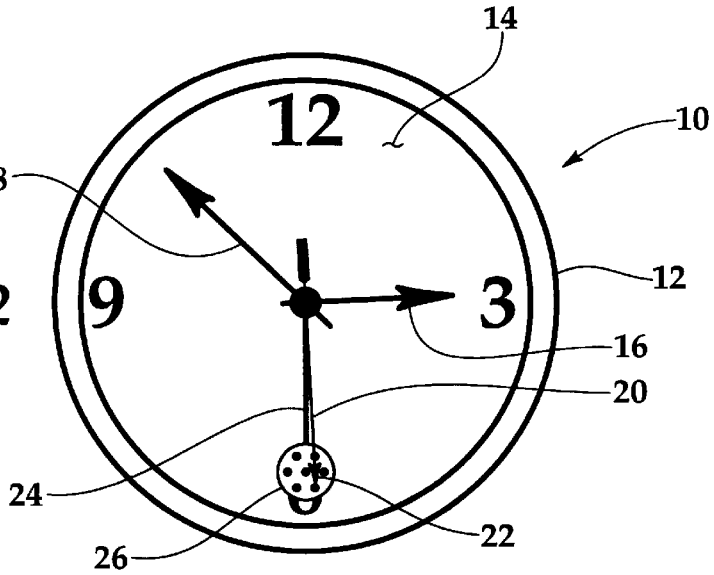
FIG. 2 is a view of FIG. 1 with a modified second hand coming in contact with a freely pivotable object support hand.
Figure 3:
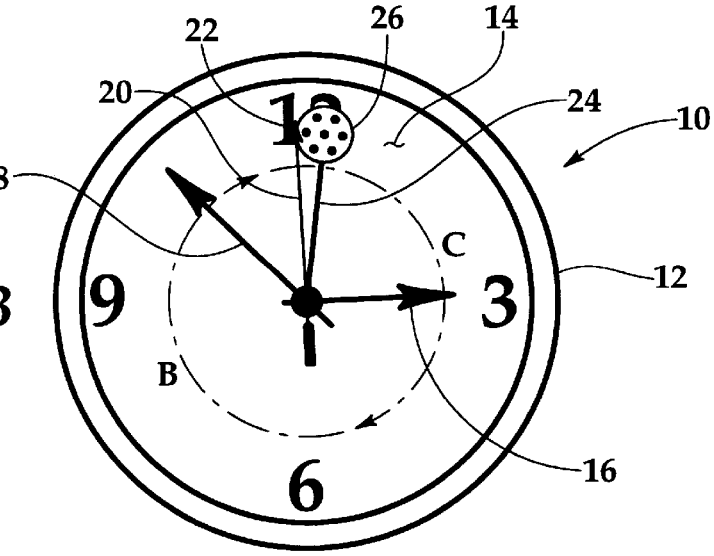
FIG. 3 is a view similar to FIG. 2 at each point in time that the second hand is at its upwardly-most sweep, the object support hand just beginning a free fall pendulum like movement back to the downwardly at-rest position.
Figure 4:
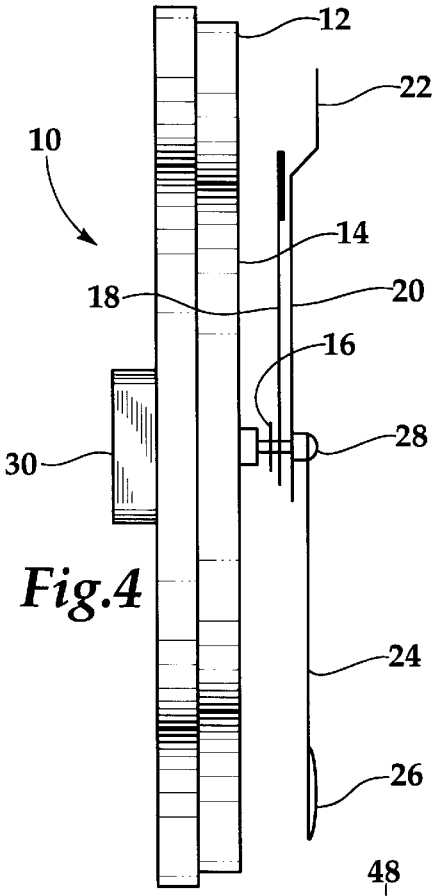
FIG. 4 is a side elevation view of FIG. 1.
Figure 5:
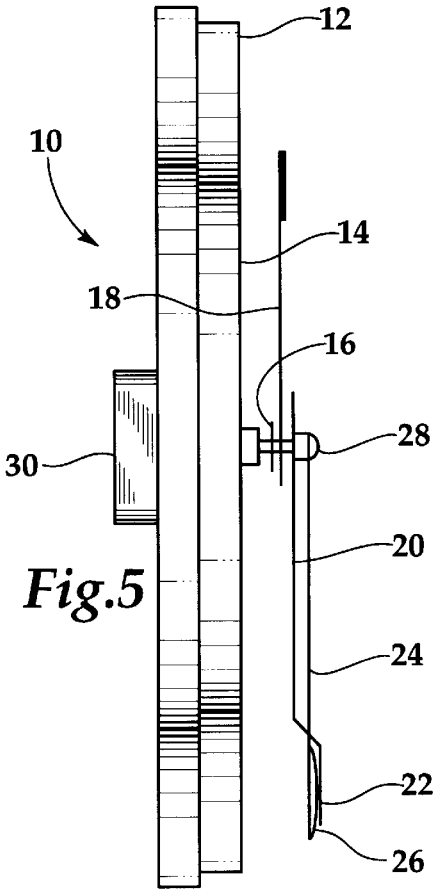
FIG. 5 is a side elevation view of FIG. 2.

When the object support hand 24 is at rest, it hangs downwardly as shown in FIG. 1 in a generally stationary upright orientation. However, the second hand 20 is modified by having a formed distal end 22 which, in this embodiment 10, forwardly extends so as to releasable engage with the distal end portion 26 of the object support hand 24 as best seen in FIGS. 2 and 5. This supportive contact engagement occurs each time the second hand 20 sweeps downwardly in the direction of arrow A in FIG. 1 to make contact with the object support hand 24. At this point generally in the downwardly or six o'clock orientation, the second hand 20 appears to contact and then carry the object 26 through an arc B to the top of the arc of the second hand 20. At this point, a seen in FIG. 3, the object support hand 24 and connected or unitary distal object 26 will free fall downwardly in pendulum fashion in the direction of arrow C and may swing back and forth until coming to its downwardly oriented at-rest position shown in FIG. 1. This typically occurs before the next time the second hand 20 reaches its downwardly or six o'clock position to repeat this cycle.

Figure 6:
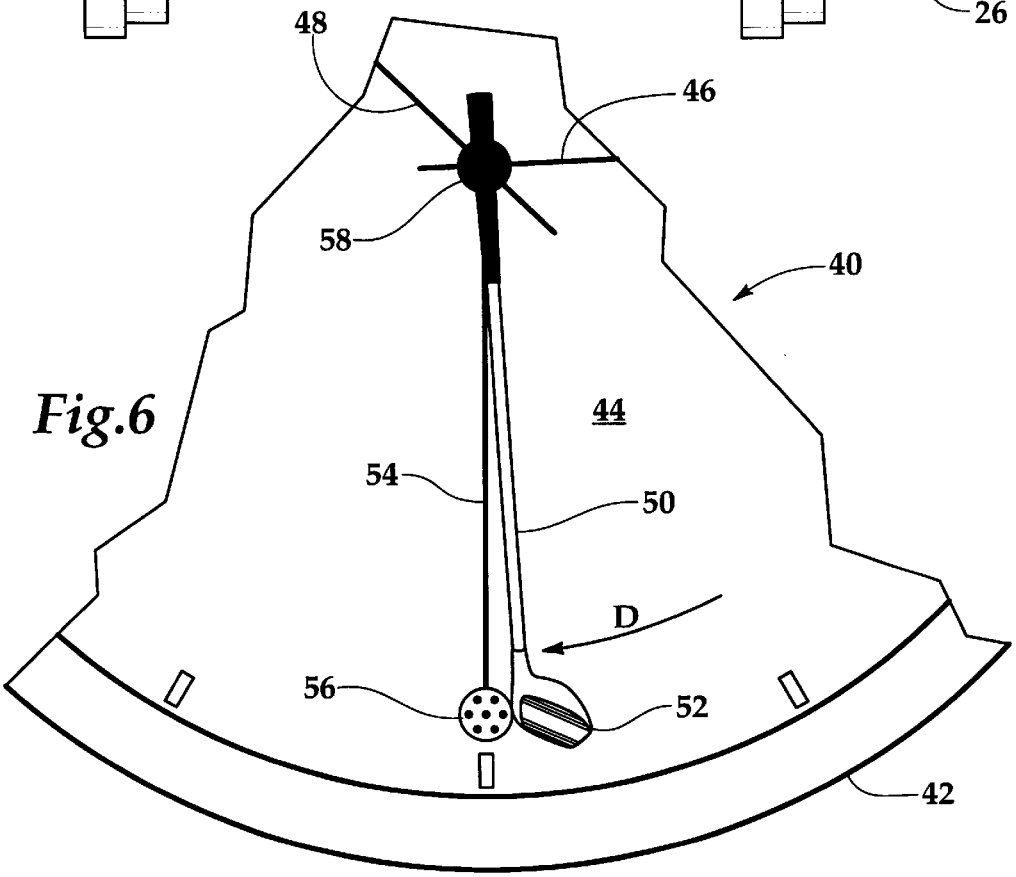
FIG. 6 is a partial front elevation view of a sports-related (preferably golf related) embodiment of the invention.

Referring additionally to FIG. 6, the preferred embodiment of the invention is shown generally in partial view at 40 and also includes a clock housing 42 and associated clock timing mechanism (not shown) which is positioned behind the face 44 of the clock 40. The hour hand 46 and minute hand 48 are operably connected to the output shaft 58 of the clock timing mechanism (not shown) and operate in a conventional timekeeping manner. Likewise, the second hand 50 also operates in keeping time in the conventional manner.

This embodiment 40 also includes a freely pivotable object support hand 54 which includes a very slender unobtrusive rigid wire pivotally connected at its inner or proximal end to the output shaft 58 and includes an enlarged distal portion 56 having the appearance of a miniature golf ball. the second hand 50 is in the shape of a miniature golf club having a conventional shank and handle portion which is pivotally connected for free rotation at the proximal end of the second hand 50 to the output shaft 58 as previously described. The distal portion 52 of the second hand 50 has the appearance of a golf club.

At each controlled or regulated revolution of the second hand 50 in the direction of arrow D, at the downwardly portion of its arc, the golf club head 52 appears to strike the golf ball 56. Although not shown in FIG. 6, the releasable interengaging structure between the second hand 50 and the object support hand 54 is similar to that described in FIGS. 4 and 5 above. By this arrangement, the head of the golf club 52 appears to strike and carry the golf ball 56 through an arc of about 180°0 to the top of the sweep of the second hand 50 whereupon the simulated golf ball 56 and object support hand 54 freely rotate downwardly in pendulum fashion back to the at-rest position for the next downwardly sweep of the second hand 50.

A broad variety of additional sports related objects and striking implements are intended within the scope of this invention. Such related sports equipment might be a tennis racket and tennis ball, a hockey stick and hockey puck, a crochet mallet and ball, a baseball and bat, a football and the foot and leg of a kicker and so on. The only intended limitation in this regard, whether sports related or otherwise, is the addition of the freely pivotable object support hand having nothing to do with the keeping of time by the clock instrument itself.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A clock which repeatedly simulates a strikeable sports object being struck by an associated sports object striking implement, comprising:

a clock face;

a clock timing mechanism positioned behind said clock face operably connected by an output shaft thereof to substantially straight, elongated, slender hour, minute and second hands;

an elongated substantially straight, slender sport object support hand connected adjacent said second hand for free rotation to said output shaft and having a viewable simulated sport object positioned at or adjacent a distal end of said support object support hand whereby said sport object hangs substantially downwardly in pendulum fashion from said output shaft when at rest;

a proximal portion of said sport object support hand being substantially shorter and of lesser weight than that of a distal portion of said sport object support hand;

said distal portion having a somewhat Z-shaped formed offset end which extends axially with respect to said output shaft a distance sufficient to engage against said object support handle each time said second hand passes said sport object support hand when at rest whereby a visual effect of said sport object support hand being struck and carried by said second hand upwardly to the top of an arc of movement of said second hand whereupon said sport object support hand freely rotates by gravity from said second hand downward to be at rest is repeated;

said sport object support hand having a simulated said sports object striking implement whereby said sport object appears to be struck and to fly each time said second hand engages said sport object support hand.

* * * * *